US006851413B1

(12) United States Patent
Tamol, Sr.

(10) Patent No.: US 6,851,413 B1
(45) Date of Patent: Feb. 8, 2005

(54) METHOD AND APPARATUS TO INCREASE COMBUSTION EFFICIENCY AND TO REDUCE EXHAUST GAS POLLUTANTS FROM COMBUSTION OF A FUEL

(75) Inventor: Ronald A. Tamol, Sr., Midlothian, VA (US)

(73) Assignee: Ronnell Company, Inc., Richmond, VA (US)

( * ) Notice: Subject to any disclaimer, the term of this patent is extended or adjusted under 35 U.S.C. 154(b) by 0 days.

(21) Appl. No.: 10/340,229

(22) Filed: Jan. 10, 2003

(51) Int. Cl.[7] ..... F02M 33/00
(52) U.S. Cl. ..... 123/536; 123/538
(58) Field of Search ..... 123/536–539; 210/222, 695; 239/690, 128; 725/111

(56) References Cited

U.S. PATENT DOCUMENTS

| | | | | |
|---|---|---|---|---|
| 4,048,963 | A | | 9/1977 | Cottell |
| 4,052,139 | A | | 10/1977 | Paillaud et al. |
| 4,188,296 | A | | 2/1980 | Fujita |
| 4,347,825 | A | | 9/1982 | Suzuki et al. |
| 4,401,089 | A | | 8/1983 | Csaszar et al. |
| 4,460,516 | A | * | 7/1984 | Kapitanov et al. ..... 261/1 |
| 4,494,167 | A | * | 1/1985 | Molyneux-Berry ..... 361/270 |
| 4,582,475 | A | * | 4/1986 | Hoppie ..... 431/6 |
| 4,605,523 | A | | 8/1986 | Smillie |
| 4,672,938 | A | | 6/1987 | Hoppie et al. |
| 4,879,045 | A | | 11/1989 | Eggerichs |
| 5,061,462 | A | * | 10/1991 | Suzuki ..... 422/186.04 |
| 5,092,760 | A | | 3/1992 | Brown et al. |
| 5,129,382 | A | | 7/1992 | Stamps, Sr. et al. |
| 5,159,915 | A | | 11/1992 | Saito et al. |
| 5,234,170 | A | * | 8/1993 | Schirmer et al. ..... 239/690 |
| 5,307,779 | A | * | 5/1994 | Wood et al. ..... 123/538 |
| 5,313,123 | A | | 5/1994 | Simuni |
| 5,507,267 | A | | 4/1996 | Stuer |
| 5,915,626 | A | * | 6/1999 | Awarzamani et al. ..... 239/135 |
| 5,992,398 | A | | 11/1999 | Ho |
| 6,264,899 | B1 | | 7/2001 | Caren et al. |

* cited by examiner

*Primary Examiner*—Marguerite McMahon
(74) *Attorney, Agent, or Firm*—John H. Thomas, P.C.

(57) ABSTRACT

A method and apparatus is disclosed for increasing combustion efficiency in internal combustion engines and external combustors resulting in increased fuel economy and reduced exhaust pollutants. The same principles and apparatus of the invention are used in the exhaust stream to further reduce pollutants.

12 Claims, 1 Drawing Sheet

METHOD AND APPARATUS TO INCREASE COMBUSTION EFFICIENCY AND TO REDUCE EXHAUST GAS POLLUTANTS FROM COMBUSTION OF A FUEL

FIELD OF THE INVENTION

The present invention relates to a method and apparatus for enhancing combustion of fuels. More particularly, the present invention relates to a method and apparatus for enhancing combustion of fuels in an internal combustion engine or an external combustion device, to achieve increased fuel efficiency and concurrently reduce or eliminate pollutants generated due to incomplete combustion.

BACKGROUND

The increasing usage of the world's petroleum resources for combustion is rapidly depleting known reserves. A corresponding problem exists due to increasing pollutants being generated by internal combustion engines. These pollutants threaten the health of residents in metropolitan areas throughout the world. Legislation has been enacted to force automobile and truck manufacturers to control emissions and to increase engine efficiency. More legislation in this area is anticipated.

The general conditions of combustion, especially regarding internal combustion engines, are well known. The Spark Ignition engine (SI) requires a near stoichiometric mixture of fuel and air to be supplied to a combustion chamber. The mixture is compressed by a piston and ignited by a spark plug providing energy of combustion to drive the piston downward creating the power stroke. Ideally, with a perfect fuel and air mixture, uniform distribution throughout the cylinder, and perfect flame front ignition, the hydrocarbon fuel would be completely burned with a resulting exhaust mixture of $CO_2$, $H_2O$, and nitrogen. This ideal environment, however, cannot be achieved in the real world. Real world conditions include incomplete combustion and less than ideal efficiencies of thermodynamic cycles. The actual conditions that exist in internal combustion engines result in polluting exhaust products of unburned hydrocarbons, oxides of nitrogen (NOx), carbon monoxide and particulate matter.

The design of the SI engine to increase fuel efficiency requires a higher level of refining of the petroleum stock along with the production and addition of a number of additives to prevent pre-ignition and the corresponding engine damaging knock. The high compression of these engines also results in higher combustion temperatures that generate oxides of nitrogen along with other products that pollute the immediate surroundings. The two-stroke SI engine is an inherent polluter. Unburned fuel and lubricating oil exit with the products of combustion in the exhaust.

The other major engine design is that of the Diesel Compression Ignition engine (CI). In this engine, the charge of fuel and air mixture is ignited spontaneously due to the heat generated when a high level of cylinder compression is achieved. The CI engine has several advantages over the SI engine. It requires a less refined and cheaper fuel. The high compression ratio and leaner fuel to air mixture results in a more efficient combustion of the fuel from an energy recovery point of view. The CI engine, however, has some serious drawbacks. The exhaust of its unburned fuel contains particulate and other gaseous pollutants, such as sulfur compounds, due to its less refined fuel stock.

It is again being proposed to put in place government mandated increases in fuel efficiency to obtain improved manufacturers' fleet mileage in the United States. The original approach by manufacturers was to achieve fuel efficiency by weight reduction and reduction of vehicle size. The automobile owning public would only accept size reduction to a point where the passenger compartment was found to be too small. The smaller automobiles were also found to be less crash resistant resulting in more accident fatalities, especially when involved with a significantly larger and heavier vehicle. Recently, the move by the driving public in the United States to sport utility vehicles with significantly larger size/weight and a corresponding lowered gas mileage, has been a contradiction to the problem.

Over the years, there have been numerous attempts to increase fuel efficiency in internal combustion engines. Along with mechanical engine design changes, there have been attempts to further increase engine efficiency and reduce pollutant products by attacking the problem in the cylinder combustion by modifying the condition of the fuel supplied to the cylinder. One attempt has been to increase fuel atomization by utilizing higher fuel pressure and smaller orifice injection nozzles to achieve improved combustion due to the formation of smaller sized fuel droplets thus aiding evaporation. Another combustion improvement has been to control the fuel injection sequence in such applications as stratified charge injection. Success in reducing pollutants at their source, the combustion zone, has been limited and the emphasis by manufacturers, government and academia researching this problem, has concentrated on the exhaust system.

There have also been significant attempts to improve combustion efficiency of a fuel by treating various parts of the combustion process, the first is precombustion treatment of the fuel or air supply or both. The second is treatment within the combustion zone, and the third is exhaust pollutant treatment, such as improvements to the catalytic converter.

Precombustion Treatment

One of the first proposals for increasing engine efficiency was to preheat the fuel or fuel mixture before it entered the cylinder. U.S. Pat. No. 4,524,746 describes the use of a closed vaporizing chamber and heats and vaporizes fuel with an ultrasonic transducer. U.S. Pat. No. 4,672,938 describes the use of fuel heating and a second fuel activation device to achieve hypergolic combustion. U.S. Pat. No. 6,202,633 de scribes the use of a reaction chamber with heat and an electric potential to treat the fuel. One obvious disadvantage of preheating the fuel and/or fuel to air mixture, is the fact that less mass of combustibles will be transferred to the combustion chamber now that they are at higher temperatures. This will result in a reduction in horsepower for the same displacement volume engine. Note that a common approach in Diesel engines of today, is the use of turbochargers with an air aftercooler to cool the compressed air which supplies more mass of air to facilitate combustion and increase engine horsepower.

Another early method attempting to increase engine efficiency dealt with treating the fuel with a magnetic field as it is supplied to the fuel/air stream to increase its combustibility. Reasoning behind this approach cited the successful molecular rearrangement by the magnetic treatment of water circulated within piping in the water treatment and chemical industry. These water magnetic treatment devices are used to prevent mineral scaling or remove mineral scale that builds up with time. These devices have been somewhat successful in replacing chemical treatment.

There are numerous devices relating to magnetic treatment of fuel lines claiming to obtain enhanced combustibility of the fuel supply and a reduction in pollutants. These devices are described in U.S. Pat. Nos. 4,572,145, 4,188,296 and 5,129,382, in which permanent magnets are attached to the fuel line prior to introduction of fuel into an air mixing duct. The mixture is then drawn into the combustion mixing zone of an internal combustion engine. These patents claim that molecular fuel agglomerates are reduced and free radical and ionized fuel components are produced in the fuel thereby enhancing combustion resulting in increased fuel mileage and engine horsepower.

Electric field treatment of fuels has also been proposed. The use of dielectric beads between electrodes to treat the flow through fuel is described in U.S. Pat. No. 4,373,494. U.S. Pat. No. 5,167,782 describes a voltage being placed on a special metal composition which is in contact with the fuel.

The permanent magnets can be replaced with electromagnets as claimed in U.S. Pat. No. 4,052,139. Still further treatment of the fuel feed is accomplished by the use of ultrasonic, UV, and IR radiation described in U.S. Pat. Nos. 4,401,089, 4,726,336 and 6,082,339, respectively.

Catalytic treatment of fuels or its combination with other devices has been described. U.S. Pat. No. 5,451,273 claims that a special cast alloy fuel filter will improve combustion efficiency by catalytic means. U.S. Pat. No. 4,192,273 claims metal plates plated with a palladium catalyst being placed within the intake manifold to create turbulence and mix the catalyzed gases enhances combustion. Turbulent flow of the fuel over several catalytic screens of different metals to catalytically condition the fuel is also described in U.S. Pat. No. 6,053,152.

A far infrared ray emitting device placed within the fuel line to aid combustion is described in U.S. Pat. No. 6,082,339.

Treatment of air or gaseous fuel mixtures by magnets for internal combustion engines, has also been described, with the object of reducing emissions in U.S. Pat. No. 6,178,953. U.S. Pat. Nos. 4,572,145 and 4,188,296 also describe the treatment of air or air/fuel mixtures with magnets.

The combustion air supply can be treated with electric fields. There are a number of precombustion ionization devices that generate high strength electric fields to ionize air in the air supply. U.S. Pat. Nos. 5,977,543 and 5,487,874 are notable.

Means other than magnets or electric fields to treat fuel or air or air/fuel mixtures to increase engine efficiency are described in a significant number of United States patents. They apply combustion enhancing treatment either to the combustion air stream or to the fuel/air stream to increase fuel efficiency. Enhancement mechanisms include IR and electromagnetic field energy as cited in U.S. Pat. No. 6,244,254. High voltage ion generators are used to treat air in U.S. Pat. No. 5,977,716. U.S. Pat. No. 6,264,899 claims the conversion to the hydroxyl radical and other radical species in the air stream, can be achieved by the use of primarily UV radiation and secondarily Corona discharge devices in the supply air stream.

Despite the numerous inventions addressing this problem, there still exists a need for improved enhancement of combustion.

Precombustion Treatment-Injector Nozzles

The pressure of the fuel supply to the fuel injectors has been increased over time in internal combustion engine development. The goal has been to produce smaller fuel droplets. Injection pressures for the Gasoline Direct Injection engine (GDI) are as much as ten times those of the present fuel/air intake systems.

Another method of heating fuel prior to the combustion chamber is located at the nozzle itself. U.S. Pat. No. 5,159,915 describes heating the complete injector by an electromagnetic coil that generates a fluctuating magnetic flux density. It also uses a magnetically sensitive material in the nozzle section to concentrate the heating magnetic field.

Another goal in fuel injection has been to charge the fuel droplets. U.S. Pat. No. 4,051,826 describes the fuel tube and injector nozzle being charged to a high electrical potential to charge the fuel droplets, conditioning the fuel droplets for efficient combustion. U.S. Pat. No. 4,347,825 describes the use of high voltage to electrify fuel particles to prevent them from attaching to the oppositely charged surrounding walls of a fuel passage. It uses an electrode near the injector nozzle.

U.S. Pat. No. 6,305,363 uses an air assisted fuel injector that injects directly into the combustion chamber of a Direct Injection Engine. The air supplied to the injector is ozone enriched to assist in the combustion process.

Despite the numerous inventions addressing this problem, there still exists a need for improved enhancement of combustion.

In-Cylinder Combustion Enhancement

This category can be divided into two subcategories. The first is treatment that supplies combustion enhancing chemical compounds to the combustion zone such as ozone. The second are devices that apply combustion enhancing energy to the combustion chamber itself.

An early combustion enhancing compound that was added to internal combustion engines was water. Water injection has been used in internal combustion engines since the first decade of the century. The original purpose was for engine cooling. It was later shown to give octane improvement and was used in aircraft engines. U.S. Pat. No. 4,018,192 describes injecting water directly into the combustion chamber through the spark plug opening to increase power and fuel economy. U.S. Pat. No. 5,255,514 also describes using water vapor to increase engine efficiency. U.S. Pat. No. 6,264,899 describes improving engine performance by adding the (—OH) radical obtained by treating a high water vapor/air stream with UV radiation or an electrical discharge device to improve combustion.

U.S. Pat. No. 4,308,844 describes using an ozone generator in the air supply to produce ozone and positively charged particles. U.S. Pat. No. 5,913,809 describes an ionization field across the air flow path producing ozone for both the intake and exhaust systems. A UV light source could be substituted to ionize the oxygen in the air stream.

A method of irradiating inlet air by alpha-decay to transform by fission, a part of nitrogen in the air into monatomic oxygen, and monatomic hydrogen to reduce toxic components in the exhaust stream, is contained in U.S. Pat. No. 5,941,219.

The concept of adding energy directly to the combustion chamber is described in U.S. Pat. No. 5,983,871 where a laser beam is introduced within the cylinder to decrease the slow initial stage of laminar combustion, therefore improving the combustion process. U.S. Pat. No. 4,176,637 has a high voltage electrode within the combustion chamber surrounding the fuel injector fuel stream to charge the fuel particles.

Despite the numerous inventions addressing this problem, there still exists a need for improved enhancement of combustion.

Exhaust Stream Treatment

Following the successful development of the catalytic converter for the SI engine, the activities surrounding further exhaust treatment were limited. There has been recent worldwide government action mandating further reduction in pollutants for the Diesel engine. A very significant effort by manufacturers, affected government agencies and academia has been and is currently underway in the United States to solve the remaining exhaust pollution problem.

The existing catalytic converter for the SI engine cannot be successfully used for the CI engine exhaust stream. The problem of excessive particulate is being addressed with a particulate trap technology. These traps must be regenerated and fuel addition to the trap is one method being developed. NOx traps are also under development.

The sulfur component in the exhaust fouls the existing catalyst types and alternate catalyst development is underway, faced with a complex problem. One solution is the refining of fuel to remove the sulfur compounds. Another possible solution under investigation is to add reducing compounds such as ammonia, or urea to undergo a chemical reaction with exhaust compounds in the exhaust stream.

Another area of research is the application of a non-thermal plasma device to oxidize pollutants. Combining this technology with a following catalyst section is actively being pursued.

Cold start pollution and catalyst light off are problem areas being addressed.

There has been a recent increase of inventions in this exhaust area of investigation. Some of these utilize very sophisticated sensor detection and computer control of engine operation within lean and rich mixtures.

U.S. Pat. No. 6,264,899 presents a method using UV radiation to produce hydroxyl ions in the exhaust stream to reduce pollutants. U.S. Pat. No. 5,913,809 claims the addition of ozone to the exhaust stream to reduce pollutants.

A significant number of U.S. patents have issued for catalyst systems. U.S. Pat. No. 6,294,141 uses a two catalyst system for a Diesel engine where the soot formed on the second catalyst is combusted by $NO_2$ containing gas from the first catalyst.

Heretofore, efforts to enhance combustion in the combustion zone have not been earnestly pursued and emphasis has been placed on the cleanup of exhaust pollutants by several means.

It is clear that a myriad of means to add energy or alter the combustion process has been put forth but is fragmented and not based on a sound unified theory explaining results. Most of these fragmented solutions have not included practical, economic hardware devices for their implementation. It is the purpose of this invention to present a method and apparatus that will solve the problems of incomplete combustion and exhaust gas pollutant control.

OBJECTS OF THE INVENTION

One object of the present invention is to provide a method and apparatus to enhance combustion of fuels to achieve more complete combustion thereby significantly improving combustion efficiency in internal combustion engines and external combustion processes.

Another object of the invention is to provide a method and apparatus to reduce the formation of exhaust pollutants due to more ideal and complete combustion conditions and to further combust any remaining pollutants as they exit the combustion process in the exhaust stream.

Another object of the invention is to make practical and economical changes to new and existing internal and external combustion and exhaust system configurations to save fuel and reduce world usage of petroleum and other combustion resources.

SUMMARY OF THE INVENTION

The fuel is treated to enhance combustion by placing a configuration having an electric field component and a magnetic field component just before or within the fluid feed section of the injector body. An improved fuel feed nozzle may be used to enhance combustion of the fuel. Said nozzle comprises both an electric field component and a magnetic field component.

The air is treated to enhance combustion by placing a configuration having an electric field component and a magnetic field component within the air stream conduit.

The in-cylinder combustive mixture is treated to enhance combustion by placing a configuration having an electric and magnetic field component within the combustion chamber.

The exhaust is treated by placing a configuration having an electric field component and a magnetic field component in the exhaust stream prior to the catalytic converter. Another configuration would be to incorporate the electric and magnet components directly within the catalytic converter.

Finally, the exhaust is treated by placing a configuration having an electric field component and a magnetic field component within the emission gas return (EGR) conduit.

DESCRIPTION OF THE PREFERRED EMBODIMENTS

The Fuel Stream

Figure 1:
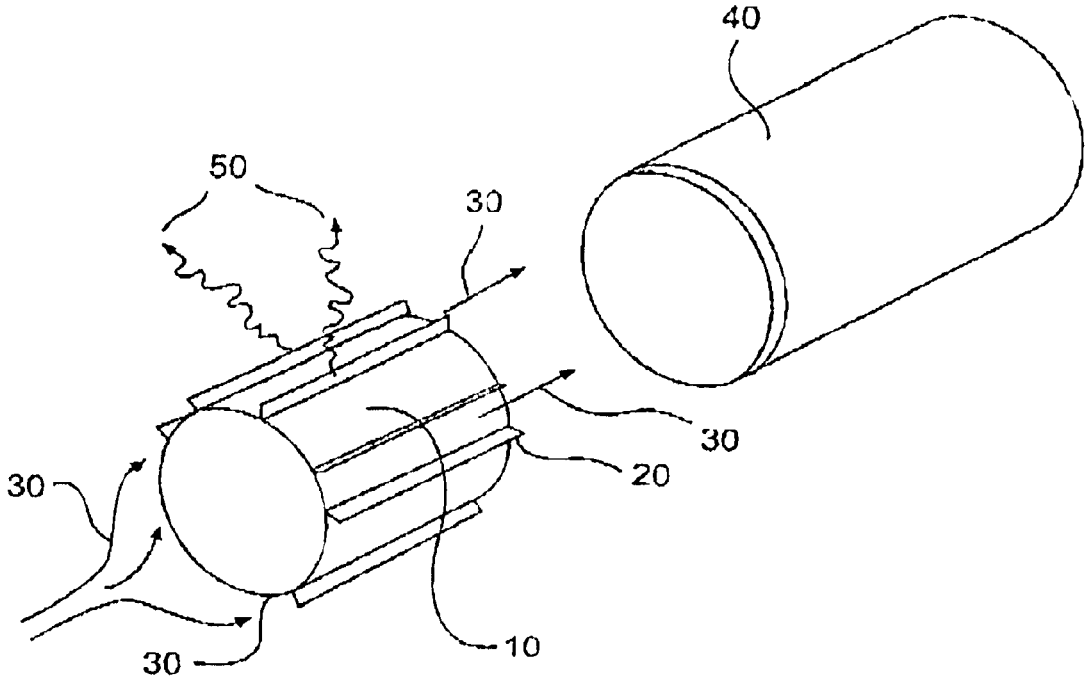
FIG. 1 is an exploded view of a fluted design magnetic or electric field component that can be inserted within a fuel line or body section of an injector.

The fuel is treated to enhance combustion by placing a configuration having an electric field component and a magnetic field component just before or within the fluid feed section of the injector body. Said configuration may be a single cylinder comprising two semi-circular segments of electric and magnetic field components, concentric cylinders of alternating electric and magnetic field components or a single cylinder having ail outer and inner side wherein said outer side is the electric field component and said inner side is the magnetic field component.

The electric field component may be an electret. Said electret may be a polymer and said polymer may be selected from the group consisting of polymethyl methacrylate, polyvinylchloride, polytetrafluoroethylene, polyethylene terafthalate, polystyrene, polyethylene, polypropylene, polycarbonate, polysuflone, polyamides, polymethylsiloxane, polyvinylfloride, polytrifluorochloroethylene, polyvinylidine fluoride epoxide resin, polyphenyleneoxide, poly-n-xylylene and polyphenylene. Said electret may also be an inorganic material. Said inorganic material may be selected from the group consisting of of titanates of alkali earth metals, aluminum oxide, silicon dioxide, silicon dioxide/silicon nitrade, Pirex® glass, molten quartz, borosilicate glass and porcelain glass. Finally, said electric field component may be selected from the group consisting of a dielectric barrier discharge device, a corona discharge device, an E-beam reactor device and a corona shower reactor device.

The magnetic field component may be made from a permanent magnet of a rare earth composition. The magnetic field component may be selected from the group consisting of Samarium-cobalt, Alnico, Neodymium-iron-boron and electromagnets.

The electret has a permanent electric field and is analogous to a permanent magnet. The pre-combustion treatment of the fluid stream, decreases molecular agglomeration by reducing effects of Van DerWaals forces, increases electric charge density and electric current density and decreases fluid density. Fluid density is an important parameter of magnetohydrodynamics with a small change in density resulting in a large change in particle acceleration. These conditions create an equivalent temperature increase in the fuel. A non-thermal plasma treatment is thereby achieved creating ions, electrons, charge neutral molecules and other species in varying degrees of excitation in the fuel stream.

It is desirable to submit the fuel prior to combustion to the highest magnetic and electric field possible to alter its molecular makeup. This high field strength treatment can best be obtained by subjecting a thin film of fuel to the magnetic and electric fields. The electric and magnetic field component may form a fluted wall placed within the fuel line thereby creating a small annular space through which a thin flowing film of fuel may be forced to flow.

Another method to obtain a very thin fuel path would be that of fabricating a fuel filter-like element from a magnetic and electric field-producing material. Fuel filters are able to filter-out solid materials in the 6–20 micron range. It follows that the fuel path is also subjected to a flowing fuel thickness of the same dimension range. A similar porous filter configuration could be made of magnetic and electric materials, such as a high strength rare earth magnet and a high field strength electret, either of sintered particle or polymer bonded construction. This configuration would provide an almost end point treatment of a thin liquid film to a maximum field strength.

An improved injector fuel feed nozzle may be used to enhance combustion of the fuel. Said nozzle comprises both an electric field component and a magnetic field component. In one embodiment, the electric field and magnetic field components are contained within the interior of the nozzle. In another embodiment, the nozzle section of the injector is made of a magnetic material. The magnetic field embraces the injected fuel stream and extends into the combustion chamber as is the case with the CI engine. The nozzle is the source of the magnetic field vector. The nozzle also contains an electric field component as supplied by a nozzle discharge section made of an electric field material and adjacent to, or inserted within the magnetic portion of the nozzle. In this configuration, both the electric and magnetic fields are supplied to the fuel and air mixture immediately before and during combustion in the CI engine. In yet another embodiment, electric field and magnetic field components could be inserted into the exterior of the nozzle. In the existing SI engine, the two fields would project into the combustion chamber until the intake valve closes. In addition, the two field components could be maintained within the cylinder by a spark plug that has field emitting electret and magnetic materials surrounding the electrode portion of the spark plug.

Figure 2:
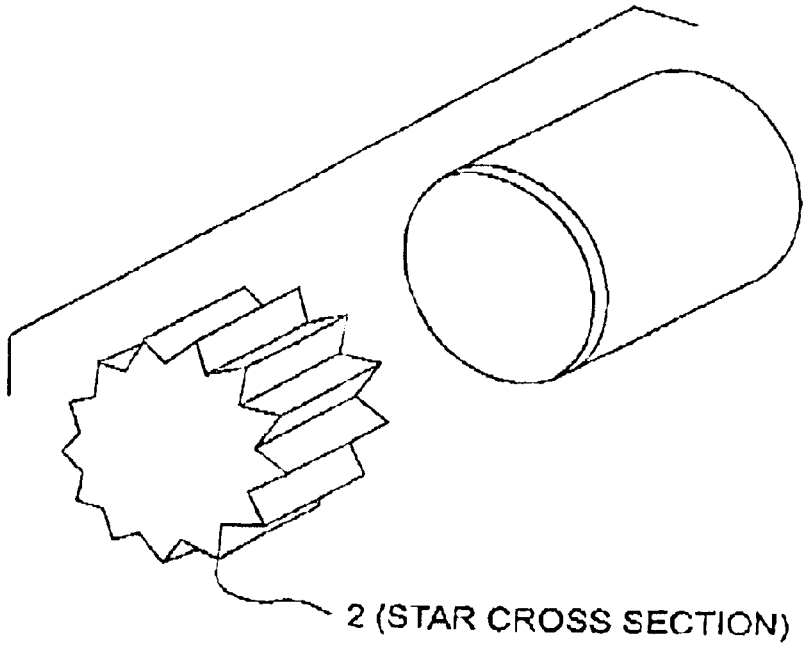
FIG. 2 is an exploded view of a magnetic or electric field component consisting of a multi-star edged design that can be inserted within a fuel line or body section of an injector.

The pre-combustion fuel treatment may be applied at two sections of the fuel injector. As shown in FIG. 1, the first section is the fuel inlet section of the injector which may have a permanent magnet segment 10 with a flirted wall 20 that directs a thin film of fuel 30 between the magnetic segment 10 and the injector wall 40. In one embodiment, the permanent magnet section is made from Samarium Cobalt, a rare earth permanent magnet material. A resulting very height magnetic field strength in the radial direction 50 will treat the thin cross section fuel steam creating ions and free radicals that are the first stage of the enhanced combustion process. FIG. 2 shows an alternative multifaceted star cross-section design with the same relationship of the fuel flow and field direction as explained under FIG. 1.

The nozzle section with its electric and magnetic field emitting devices also favorably affects fuel droplet formation. The fuel is charged by the phenomenon of triboelectrification as it contacts the electric/magnetic surface of the nozzle and is injected into the cylinder. The charge on the dielectric fuel will be further multiplied by the nozzle electric and magnetic fields that exist within the cylinder immediately at the exit of the nozzle. This action is analogous to the manufacture of an electret material from a polymeric extrusion as it exits an extrusion nozzle into a polarizing electric or magnetic field. It can also be described as an electrostatic fuel atomizer. The highly desirable effect of producing charged particles of very small dimensions will therefore be achieved. Charged particles breakdown into still smaller particles due to Coulomb and Rayleigh instability effects which reduce surface tension and breakup charged particles into still smaller entities. The result is a fine homogeneous dispersion of charged fuel droplets that will not re-agglomerate due to their like charge and will very uniformly disburse throughout the combustion cylinder. The smaller the reactive fuel droplets, the more easily they will vaporize and be available as the necessary precursor for the combustion process to begin. Electrostatic fuel atomizers have been shown in the literature to produce ultra-fine (less than 10 microns) droplet distributions with maximum self-dispersal properties.

The Air Stream

The air is treated to enhance combustion by placing a configuration having an electric field component and a magnetic field component within the air stream conduit. One embodiment of said configuration is a honeycomb shape.

The electric field component may be an electret. Said electret may be a polymer and said polymer may be selected from the group consisting of polymethyl methacrylate, polyvinylchloride, polytetrafluoroethylene, polyethylene terafthalate, polystyrene, polyethylene, polypropylene, polycarbonate, polysuflone, polyamides, polymethylsiloxane, polyvinylfloride, polytrifluorochloroethylene, polyvinylidine fluoride epoxide resin, polyphenyleneoxide, poly-n-xylylene and polyphenylene. Said electret may also be an inorganic material. Said inorganic material may be selected from the group consisting of of titanates of alkali earth metals, aluminum oxide, silicon dioxide, silicon dioxide/silicon nitrade, Pirex® glass, molten quartz, borosilicate glass and porcelain glass. Finally, said electric field component may be selected from the group consisting of a dielectric barrier discharge device, a corona discharge device, an E-beam reactor device and a corona shower reactor device.

The magnetic field component may be made from a permanent magnet of a rare earth composition. The magnetic field component may be selected from the group consisting of Samarium-cobalt, Alnico, Neodymium-iron-boron and electromagnets.

The electric and magnetic field components described herein may be incorporated into the incoming air stream conduit of either a CI or SI internal combustion engine or external combustion device. The air stream is subjected to electric and magnetic fields and undergoes a non-thermal plasma treatment. These fields act on the air stream and its water constituent to create ions and free radicals and will increase both electric and current charge density of the air particles. This condition results in an enhanced oxidizing condition of the air stream, and when combined with the fuel nozzle treatment as above, creates a more ideal combustion condition. It would also be desirable to treat the air stream to create charged air particles of opposite polarity to those of the charged fuel particles for further combustion enhancement.

The addition of electric and magnetic field components to the air stream has a significant affect on the water molecules within the incoming air stream. The hydroxyl radical is formed and when introduced into the combustion process, enters into a chemical chain reaction which can also be categorized as a catalytic reaction. It appears that a relatively small amount of $H_2O$ is needed to start and maintain the reaction. By using the electromagnetic wave field components of this invention, the amount of moisture already in the supply stream is believed sufficient to maintain the chain chemical reaction. However it may be desirable to add additional water by a separate injection system to achieve air at or above saturated moisture conditions.

The In-Cylinder Combustive Mixture

The in-cylinder combustive mixture is treated to enhance combustion by placing a configuration having an electric and magnetic field component within the combustion chamber. The electric and magnetic fields are maintained within the combustion zone before and during the combustion process by the aforementioned nozzle or spark plug. A continuum of combustion related events occur.

The first stage is that of a continuing non-thermal treatment of the previously injector reactively treated fuel molecules and particles. The effect of the acceleration of particles as explained by Maxwell's equation, is to create an equivalent temperature increasing effect. This effect results in earlier evaporation of fuel droplets and further ionization of the air and water vapor supply.

The second stage is the effect on the evaporated fuel molecules. They are further acted upon by the non-thermal plasma phenomenon of the fields. As a result, molecular dissociation occurs earlier at a lower temperature than that due to a mass combustion mixture temperature increase as is now the case in cylinder combustion. In the CI engine, spontaneous ignition occurs at a lower temperature. Intermediate chemical reactions are minimized as the disassociation of long chain molecules more readily occurs resulting in earlier combustion of bimolecular species. Importantly, the rate of reaction is significantly increased. The net result is a lower maximum temperature being reached during combustion reducing or eliminating NOx formation.

The last stage takes place when combustion begins to occur. The fuel/air mixture is rapidly heated and as it does, it becomes a high temperature thermal plasma. The fields within the cylinder have the same effect on this plasma per the Maxwell equation, and will be treated accordingly, further enhancing combustion leading toward near ideal combustion.

The Exhaust Stream

The first stream to be treated is the EGR stream that is returned to the combustion cylinder in both the newer CI and existing SI engine. The exhaust is treated by placing a configuration having an electric field component and a magnetic field component in the EGR conduit.

The exhaust is also treated by placing a configuration having an electric field component and a magnetic field component in the exhaust stream prior to the catalytic converter. Said configuration may be a tube bundle of semicircular electric and magnetic field components placed in the exhaust pipe. The magnetic material has a Curie temperature above the exhaust gas temperature and the electret material is a polymeric or inorganic material that retains its charge characteristics above the exhaust gas temperature. Enhancement of the exhaust stream occurs creating hydroxyl ions and other free radical oxidizers, creating electric charge and electric current density conditions in the unburned hydrocarbons and combusting them prior to and within the catalytic converter immediately downstream.

Another configuration would be to incorporate the electric and magnet components directly within the catalytic converter. The action of combustion due to the electric and magnetic fields of the invention may occur simultaneously with the oxidation/reduction reactions of the catalyst within the converter.

The incorporation of the electric and magnetic fields of the invention before or within the converter, results in a reduced load required on the catalyst and requires a simpler, less expensive catalyst loading. Another result is an increase in engine efficiency due to a reduction in pressure drop across the converter.

By using the electromagnetic wave components of this invention, the amount of moisture already in the exhaust stream should be sufficient to maintain the chain chemical reaction before and within the catalytic converter of the engine system. The hydroxyl radical enters into a chemical chain reaction which can also be categorized as a catalytic reaction, and requires a relatively small amount of $H_2O$ to start and maintain the reaction.

In some cases, it may be desirable to add water to the exhaust stream to aid the performance of the catalytic converter. If necessary, additional water can be added using components presently known in the art.

Additional Applications of the Invention

The application of the present invention is not limited to traditional internal combustion engines. There are a number of new engine types presently under varying degrees of development that can become a commercial reality by applying the invention described herein. The Gasoline Direct Injection (GDI) engine has a problem with fouling of the spark plug, cylinder fouling and produces pollutant levels that are higher than the existing multi-port engine. The incorporation of the invention described herein would correct these deficiencies. Furthermore, the use of the present invention will obtain a truly homogenous fuel mixture at all engine loads and would make the Controlled Auto-ignition engine and Homogenous Charge Compression engine viable. Finally, the present invention can readily be used on the two-stroke engine.

With regard to external combustion, many applications have a fuel injection nozzle that injects fuel directly into a flame as opposed to the periodic fuel injection that occurs in an internal combustion engine. The nozzle directly sees the high temperature flame when used in flame or turbine combustor applications. The solution to this problem is to maintain the temperature of the nozzle, no higher than its materials of construction allows. First, the area of the nozzle that is in direct contact with the flame can be kept to an absolute minimum by using a high temperature insulating material such as a heat insulating ceramic collar. Magnetic and electric fields can penetrate the insulating collar and will treat fuel particles as they exit the nozzle. Second, the nozzle can be kept cool by cooling or re-circulating the liquid fuel. Third, the nozzle body can be cooled by means of a cooling jacket or the attachment of a heat pipe. The temperature control of the nozzle would be accomplished by using these approaches or others that are well known in the heat transfer art.

The air supply to these combination burners can be treated by components of the invention that can be placed prior to the zone in which they would see the excessive temperature of the flame. Insulating and cooling of these components can be accomplished with known heat transfer cooling designs similar to those used for the liquid fuel stream and well known in the heat transfer art.

The Jet engine application uses the nozzles of the invention for the primary engine feed, but also uses them in the afterburner section for military aircraft. The air in the compressor section can be treated in the same manner as described above when applying the invention to air superchargers. Both air and fuel can be molecularly enhanced prior to and during combustion in a jet engine or gas turbine application. The exhaust system can also be treated by the invention to reduce pollutants, while not exhibiting excessive back-pressure levels to which this engine type is sensitive.

Oil and gas residential and commercial burners, also can be treated by application of the invention to obtain higher combustion efficiency and reduced pollutants.

Coal fired burners in all areas of heat and power generation can also be treated by application of the invention. Incinerators, especially those treating toxic compounds, will benefit from the enhanced combustion process of the invention.

Treatment of the exhaust stream in these stationary combustion applications can also be accomplished by application of the method and apparatus of the invention.

Retrofit

The present invention may conveniently and economically retrofit existing internal combustion engines and achieve immediate fuel savings and a horsepower increase and reduce exhaust pollutants. For the Diesel engine, replacing the fuel injectors with the new injector design of this invention would relatively easily achieve these goals. An air filter like device that exhibits the fields associated with the invention could also be easily added to the existing air intake duct system in conjunction with the injector change. It could also be added to the EGR duct. Replacement costs will be recovered from fuel savings to pay for these modifications. For city run Diesel trucks, the addition of a pollutant reduction section in the exhaust system that utilizes the principles of the invention, with the injector and air supply modification would achieve the total of all possible results achieved by the invention. This revision could be accomplished at a reasonable cost.

Like the CI engine, replacement of injectors that are located within the intake manifold with those of the in the invention design would produce a significant improvement in engine performance. In addition, replacing the existing SI engine sparkplugs with spark plugs that exhibit the embodiment of the invention would extend the fields of the invention into the cylinder like the CI engine configuration. An air filter device that exhibits the design and fields associated with the invention could easily be added to the intake air duct to condition the air supply and could also be added to the EGR duct. Application of the devices of the invention to the exhaust in this engine type would not be required to meet pollutant requirements.

Other combustors such as Gas turbines, Jet engines, oil, gas, coal fired burners, and incinerator burner external combustion devices, can be adapted to include the concepts and designs of the invention. These adaptations can easily be carried out by those skilled in the art using the basic apparatus of the invention to obtain similar enhanced combustion and pollutant reduction results.

Theory of Invention

The objectives of this invention are achieved by applying the equations of magnetohydrodynamics to the combustion and exhaust processes. The method and apparatus described herein address the terms of this equation by applying external electric and magnetic fields to obtain acceleration of particles within the fields resulting in an acceleration within a cell of particles. This increase in the mean random velocity is in essence the property called temperature.

The equation of the motion of particles in a liquid or gaseous fluid under electric and magnetic fields and the relation to the charges and fields within these fields is expressed by Maxwell's equation as follows:

$$\check{u}=1\mu\{\Delta P+\rho E+jXB\}$$

Where:

ŭ is the acceleration (time rate of change of the average velocity in a cell of particles)

P is the pressure (which depends on T and $\mu$)

$\mu$ is the density

ρ is the electric charge density j is the electric current density

E is the electric field

B is the magnetic field

The term of delta pressure in the equation is inherent in the internal combustion engine and also in other combustors that provide fuel through a nozzle into the combustion zone. The pressure at combustion depends on the absolute temperature (T) and the density of the fluid. An electric charge density is produced and is acted on by the external electric field. An electric current density is produced and is acted upon by the magnetic field vector. By significantly increasing these fields, acceleration can be increased, resulting in higher collisional forces and a higher temperature of the component particle cells. The result is a highly reactive condition of the fuel, air or mixture thereof that will enhance combustion or similar processes.

The invention provides practical and economic magnetic and electric field devices to treat the fuel and the oxidant streams, the fuel/air stream or cylinder fuel/air mixture, and the exhaust streams, per the Maxwell equation.

From the foregoing description, it may be seen that a device formed in accordance with the present invention incorporates many novel features over and offers significant advantages over those currently available. While the presently preferred embodiment of the invention has been illustrated and described, various changes can be made without exceeding the scope of the invention.

I claim:

1. A method for enhancing combustion of a fuel in a system having an injector body with a fuel path, said method comprising:

placing a configuration having an electric field component and a magnetic field component within the fuel path of the injector body, wherein said configuration has a fluted wall forming a annular space between said configuration and said injector body, whereby a film of fuel is forced to flow through said space.

2. A method for enhancing combustion of a fuel in a system having an injector body with a fuel path, said method comprising:

placing a configuration having an electric field component, and a magnetic field component within the fuel path of the injector body, wherein said configuration is concentric cylinders of alternating electric field and magnetic field components.

3. A method for enhancing combustion of a fuel in a system having an injector body with a fuel path, said method comprising:

placing a configuration having an electric field component and a magnetic field component within the fuel path of the injector body, wherein said configuration is a single cylinder having an outer and inner side, wherein said outer side is the electric field component and said inner side is the magnetic field component.

4. The method of claim 1 wherein said electret is made from an inorganic material.

5. The method of claim 4 wherein said inorganic material is selected from the group consisting of titanates of alkali earth metals, aluminum oxide, silicon dioxide, silicon dioxide/silicon nitrade, Pirex® glass, molten quartz, borosilicate glass and porcelain glass.

6. A method for enhancing combustion of a fuel in a system having an injector body with a fuel path, said method comprising, placing a configuration having an electric field component, and a magnetic field component within the fuel path of the injector body, wherein said electric field component is an electret.

7. The method of claim 6 wherein said electret is made from a polymer.

8. The method of claim 7 wherein said polymer is selected from the group consisting of polymethyl methacrylate, polyvinylchloride, polytetrafluoroethylene, polyethylene terafthalate, polystyrene, polyethylene, polypropylene, polycarbonate, polysuflone, polyamides, polymethylsiloxane, polyvinylfloride, polytrifluorochloroethylene, polyvinylidine fluoride epoxide resin, polyphenyleneoxide, poly-n-xylylene and polyphenylene.

9. A method for enhancing combustion of a fuel in a system having an injector body with a fuel path, said method comprising:

placing a configuration having an electric field component, and a magnetic field component within the fuel path of the in injector body, wherein said configuration is a porous filter-like construction.

10. A method for enhancing combustion of a fuel in a system having an injector body with a fuel path, said method comprising:

placing a configuration having an electric field component and a magnetic field component within the fuel path of the injector body, wherein said electric field component is selected from the group consisting of a dielectric barrier discharge device, a corona discharge device, an E-beam reactor device and a corona shower reactor device.

11. A method for enhancing combustion of a fuel in a system having an injector body with a fuel path, said method comprising:

placing a configuration having an electric field component, and a magnetic field component within the fuel path of the injector body, wherein said magnetic field component is a permanent magnet of a rare earth composition or an electromagnet.

12. A method for enhancing combustion of a fuel in a system having an injector body with a fuel path, said method comprising:

placing a configuration having an electric field component and a magnetic field component within the fuel path of the injector body, wherein said magnetic field component is selected from the group consisting of Samarium-cobalt, Alnico, Neodymium-iron-boron and electromagnets.

* * * * *